US009957585B2

(12) United States Patent
Takahashi et al.

(10) Patent No.: US 9,957,585 B2
(45) Date of Patent: May 1, 2018

(54) CONTINUOUS ANNEALING DEVICE AND CONTINUOUS HOT-DIP GALVANISING DEVICE FOR STEEL STRIP

(71) Applicant: JFE STEEL CORPORATION, Chiyoda-ku, Tokyo (JP)

(72) Inventors: Hideyuki Takahashi, Fukuyama (JP); Tadashi Nara, Rayong (TH)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 0 days. days.

(21) Appl. No.: 14/761,724

(22) PCT Filed: Feb. 18, 2014

(86) PCT No.: PCT/JP2014/000830
§ 371 (c)(1),
(2) Date: Jul. 17, 2015

(87) PCT Pub. No.: WO2014/129180
PCT Pub. Date: Aug. 28, 2014

(65) Prior Publication Data

US 2015/0361521 A1 Dec. 17, 2015

(30) Foreign Application Priority Data

Feb. 25, 2013 (JP) ..... 2013-035076

(51) Int. Cl.
*C21D 9/573* (2006.01)
*C22C 38/06* (2006.01)
(Continued)

(52) U.S. Cl.
CPC ..... *C21D 9/573* (2013.01); *C21D 1/26* (2013.01); *C21D 1/74* (2013.01); *C21D 1/76* (2013.01);
(Continued)

(58) Field of Classification Search
None
See application file for complete search history.

(56) References Cited

U.S. PATENT DOCUMENTS 4,415,382 A * 11/1983 Gaskey ..... C21D 9/573 148/661
5,798,007 A 8/1998 Stein
(Continued)

FOREIGN PATENT DOCUMENTS

CN 1252518 A 5/2000
CN 201250260 Y 6/2009
(Continued)

OTHER PUBLICATIONS

Sep. 1, 2015, Office Action issued by the Japan Patent Office in the corresponding Japanese Patent Application No. 2013-035076.
(Continued)

*Primary Examiner* — Jethro M Pence
(74) *Attorney, Agent, or Firm* — Kenja IP Law PC

(57) ABSTRACT

A steel strip continuous annealing device has a vertical annealing furnace 10 in which a heating zone 14, a soaking zone 16, and a cooling zone 18 are arranged in this order, and anneals a steel strip P passing through the zones 14, 16, and 18 in the order while being conveyed in the vertical direction in the vertical annealing furnace 10. The heating zone 14, the soaking zone 16, and the cooling zone 18 communicate through an atmosphere separation portion 36. One of a gas delivery port 38 and a gas discharge port 40 is positioned in an upper part and the other one of the gas delivery port 38 and the gas discharge port 40 is positioned in a lower part in each of the heating zone 14, the soaking zone 16, and the cooling zone 18.

6 Claims, 5 Drawing Sheets

(51) Int. Cl.

| | |
|---|---|
| ***C23C 2/40*** | (2006.01) |
| ***C21D 1/74*** | (2006.01) |
| ***C23C 2/02*** | (2006.01) |
| ***C23C 2/06*** | (2006.01) |
| ***C21D 9/56*** | (2006.01) |
| ***C21D 1/26*** | (2006.01) |
| ***C21D 1/76*** | (2006.01) |
| ***C21D 9/00*** | (2006.01) |
| ***C22C 38/00*** | (2006.01) |
| ***C22C 38/02*** | (2006.01) |
| ***C22C 38/04*** | (2006.01) |
| ***C23C 2/00*** | (2006.01) |
| ***F27B 9/14*** | (2006.01) |
| *F27D 7/06* | (2006.01) |

(52) U.S. Cl.

CPC ..... *C21D 9/005* (2013.01); *C21D 9/56* (2013.01); *C21D 9/561* (2013.01); *C21D 9/5735* (2013.01); *C22C 38/002* (2013.01); *C22C 38/02* (2013.01); *C22C 38/04* (2013.01); *C22C 38/06* (2013.01); *C23C 2/003* (2013.01); *C23C 2/02* (2013.01); *C23C 2/06* (2013.01); *C23C 2/40* (2013.01); *F27B 9/145* (2013.01); *F27D 2007/063* (2013.01)

(56) References Cited

U.S. PATENT DOCUMENTS

| | | | |
|---|---|---|---|
| 6,341,955 | B1 | 1/2002 | Ueno et al. |
| 2009/0123651 | A1 | 5/2009 | Okada |
| 2013/0273251 | A1 | 10/2013 | Takahashi et al. |
| 2014/0090595 | A1 | 4/2014 | Hoshino |

FOREIGN PATENT DOCUMENTS

| | | | | | |
|---|---|---|---|---|---|
| CN | 101576349 | A | | 11/2009 | |
| CN | 101787435 | A | | 7/2010 | |
| CN | 101979700 | A | | 2/2011 | |
| CN | 102363834 | A | | 2/2012 | |
| CN | 102656286 | A | | 9/2012 | |
| CN | 102747206 | A | | 10/2012 | |
| EP | 2857532 | A1 | | 4/2015 | |
| JP | 59133329 | A | * | 7/1984 | ..... C21D 9/56 |
| JP | H01-96333A | A | | 4/1989 | |
| JP | H06264151 | A | | 9/1994 | |
| JP | H08-109417 | A | | 4/1996 | |
| JP | H09-324209 | A | | 12/1997 | |
| JP | H09-324210 | A | | 12/1997 | |
| JP | H10-8145 | A | | 1/1998 | |
| JP | 2000-192151 | A | | 7/2000 | |
| JP | 2004-018967 | A | | 1/2004 | |
| JP | 2005-226157 | A | | 8/2005 | |
| JP | 2012126983 | A | | 7/2012 | |
| WO | 2007/043273 | A1 | | 4/2007 | |

OTHER PUBLICATIONS

May 13, 2014 International Search Report issued in International Patent Application No. PCT/JP2014/000830.

Feb. 5, 2016, Extended European Search Report issued by the European Patent Office in the corresponding European Patent Application No. 14753777.3.

Oct. 25, 2016, Office Action issued by the State Intellectual Property Office in the corresponding Chinese Patent Application No. 201480010126.5, with English language Search Report.

Xiufei Xu, "Countermeasures to Difficulties in Continuous Coat-plating and Annealing of Steel Strips", Mar. 31, 2010, 258-259, Chemical Industry Press, Beijing.

Zhengkuan Yun, "Designs in Metallurgical Industry, Book III: Design of Electromechanical Equipment and Industrial Furnace", Jun. 30, 2006, 952-954, Metallurgical Industry Press, Beijing.

Zuobao Fu, "Production of Cold-rolled Steel Sheet", Apr. 30, 1996, 409-508, Metallurgical Industry Press, Beijing.

May 16, 2016, Office Action issued by the State Intellectual Property Office in the corresponding Chinese Patent Application No. 201480010126.5 with English language Search Report.

* cited by examiner

CONTINUOUS ANNEALING DEVICE AND CONTINUOUS HOT-DIP GALVANISING DEVICE FOR STEEL STRIP

TECHNICAL FIELD

The disclosure relates to a steel strip continuous annealing device and a continuous hot-dip galvanising device.

BACKGROUND

As a steel strip continuous annealing device, a large continuous annealing device that anneals a steel strip by multiple passes in a vertical annealing furnace in which a preheating zone, a heating zone, a soaking zone, and a cooling zone are arranged in this order is typically used.

The following conventional method is widely employed in the continuous annealing device in order to reduce water content or oxygen concentration in the furnace, for example upon startup after opening the furnace to the air or in the case where the air enters into the atmosphere in the furnace. The temperature in the furnace is increased to vaporize water in the furnace. Around the same time, non-oxidizing gas such as inert gas is delivered into the furnace as furnace atmosphere replacement gas, and simultaneously the gas in the furnace is discharged, thus replacing the atmosphere in the furnace with the non-oxidizing gas.

However, the conventional method is problematic in that it causes a significant decline in productivity, as lowering the water content or oxygen concentration in the atmosphere in the furnace to a predetermined level suitable for normal operation takes a long time and the device cannot be operated during the time. Note that the atmosphere in the furnace can be evaluated by measuring the dew point of the gas in the furnace. For example, the gas has a low dew point such as less than or equal to −30° C. (e.g. about −60° C.) when it mainly contains non-oxidizing gas, but has a higher dew point such as exceeding −30° C. when it contains more oxygen or water vapor.

In recent years, the demand for high tensile strength steel (high tensile strength material) which contributes to more lightweight structures and the like is increasing in the fields of automobiles, household appliances, building products, etc. The high tensile strength technology has a possibility that a high tensile strength steel strip with good hole expansion formability can be manufactured by adding Si into the steel, and also has a possibility that a steel strip with good ductility where retained austenite (γ) is easily formed can be manufactured by adding Si or Al.

When a high strength cold-rolled steel strip contains an oxidizable element such as Si or Mn, however, the oxidizable element is concentrated on the surface of the steel strip during annealing to form an oxide film of Si or Mn, which leads to problems such as poor appearance and poor chemical convertibility in phosphatization and the like.

Especially in the case of a hot-dip galvanised steel strip, the following problems arise when the steel strip contains an oxidizable element such as Si or Mn: the oxide film formed on the surface of the steel strip impairs the coating property and causes an uncoating defect, or lowers the alloying speed in alloying treatment after galvanisation. Regarding Si, in particular, when an oxide film of $SiO_2$ is formed on the surface of the steel strip, the wettability between the steel strip and the molten metal decreases significantly, and also the $SiO_2$ film constitutes a barrier to mutual diffusion of the steel substrate and the galvanising metal in the alloying treatment, thus impairing the coating property and the alloying property.

This problem may be avoided by a method of controlling the oxygen potential in the annealing atmosphere. As a method of increasing the oxygen potential, for example, WO 2007/043273 A1 (Patent Literature (PTL) 1) describes a method of regulating the dew point from the latter heating zone to the soaking zone to a high dew point greater than or equal to −30° C.

CITATION LIST

Patent Literature

PTL 1: WO 2007/043273 A1

SUMMARY

Technical Problem

The technique in PTL 1 has the feature that the gas in the furnace is set to a high dew point in the specific part in the vertical annealing furnace. This is, however, merely a less desirable alternative. In theory, it is preferable to minimize the oxygen potential in the annealing atmosphere in order to suppress the formation of the oxide film on the surface of the steel strip, as described in PTL 1.

However, given that Si, Mn, or the like is easily oxidizable, it is considered very difficult to stably obtain, in such a large continuous annealing device that is installed in a continuous galvanising line (CGL) or a continuous annealing line (CAL), an atmosphere of a low dew point less than or equal to −40° C. where the oxidation of Si, Mn, or the like can be sufficiently suppressed.

We have conceived that, since the gas introduced into the vertical annealing furnace is non-oxidizing gas having a low dew point, the low dew point atmosphere may be stably obtained if the atmosphere in the furnace can be quickly switched by effectively discharging high dew point gas containing oxygen or water and present in the furnace upon operation start after opening the furnace to the air or gas which has increased in dew point due to mixture of oxygen or water during operation.

Quickly switching the atmosphere in the furnace in a large annealing device is important not only for lowering the dew point. In this respect, none of the conventional continuous annealing devices including that in PTL 1 is capable of quickly switching the atmosphere in the furnace.

It could therefore be helpful to provide a large continuous annealing device that anneals a steel strip by multiple passes in a vertical annealing furnace and is capable of quickly switching the atmosphere in the furnace, and a continuous hot-dip galvanising device including the continuous annealing device.

Solution to Problem

We measured the dew point distribution in a large vertical annealing furnace, and conducted flow analysis and the like based on the measurement. As a result, we discovered that the atmosphere in the furnace can be effectively replaced by separating the atmospheres in the respective zones in the vertical annealing furnace from each other and arranging one of a gas delivery port and a gas suction port in an upper part and the other one of the gas delivery port and the gas suction port in a lower part in each zone.

The disclosure is based on the aforementioned discoveries. We thus provide the following.

(1) A steel strip continuous annealing device that has a vertical annealing furnace in which a heating zone, a soaking zone, and a cooling zone are arranged in the stated order, and anneals a steel strip passing through the zones in the order while being conveyed in a vertical direction in the vertical annealing furnace, comprising: an atmosphere separation portion; a gas delivery port for introducing gas into the vertical annealing furnace; and a gas discharge port for discharging gas from the vertical annealing furnace, wherein the heating zone, the soaking zone, and the cooling zone communicate through the atmosphere separation portion, the gas delivery port and the gas discharge port are provided in each of the heating zone, the soaking zone, and the cooling zone, and one of the gas delivery port and the gas discharge port is positioned in an upper part and the other one of the gas delivery port and the gas discharge port is positioned in a lower part in each of the zones.

(2) The steel strip continuous annealing device according to the foregoing (1), wherein a preheating zone is arranged upstream of the heating zone, the atmosphere separation portion is also provided between the preheating zone and the heating zone, and one of the gas delivery port and the gas discharge port is positioned in the upper part and the other one of the gas delivery port and the gas discharge port is positioned in the lower part in the preheating zone.

(3) The steel strip continuous annealing device according to the foregoing (1) or (2), wherein the gas delivery port is positioned in the lower part and the gas discharge port is positioned in the upper part in all of the zones.

(4) The steel strip continuous annealing device according to the foregoing (3), wherein a flow rate Q ($m^3$/hr) per gas discharge port in each zone satisfies conditions of Expression (1) and Expression (2)

$$Q>3.93\times V \quad \text{Expression (1)}$$

$$Q>1.31\times V_0 \quad \text{Expression (2)}$$

where $V_0$ ($m^3$) is a volume of the zone, and V ($m^3$) is a volume of the zone per pair of gas delivery port and gas discharge port.

(5) The steel strip continuous annealing device according to any one of the foregoing (1) to (4), wherein a length of each of the zones is 7 m or less.

(6) A continuous hot-dip galvanising device including: the steel strip continuous annealing device according to any one of the foregoing (1) to (5); and a hot-dip galvanising device that hot-dip galvanises the steel strip discharged from the cooling zone.

Advantageous Effect

The disclosed steel strip continuous annealing device and continuous hot-dip galvanising device are capable of quickly switching the atmosphere in the furnace. Accordingly, the dew point of the atmosphere in the furnace can be quickly decreased to a level suitable for normal operation, before performing normal operation of continuously heat-treating a steel strip after opening the vertical annealing furnace to the air, or when the water concentration and/or the oxygen concentration in the atmosphere in the furnace increases during normal operation. The disclosed technique not only has the advantageous effect of lowering the dew point, but also is beneficial in terms of operation efficiency in the case where the atmosphere in the furnace needs to be replaced upon changing the steel type or the like.

DETAILED DESCRIPTION

The following describes an embodiment of the disclosed steel strip continuous annealing device (apparatus) and continuous hot-dip galvanising device (apparatus).

Figure 1:
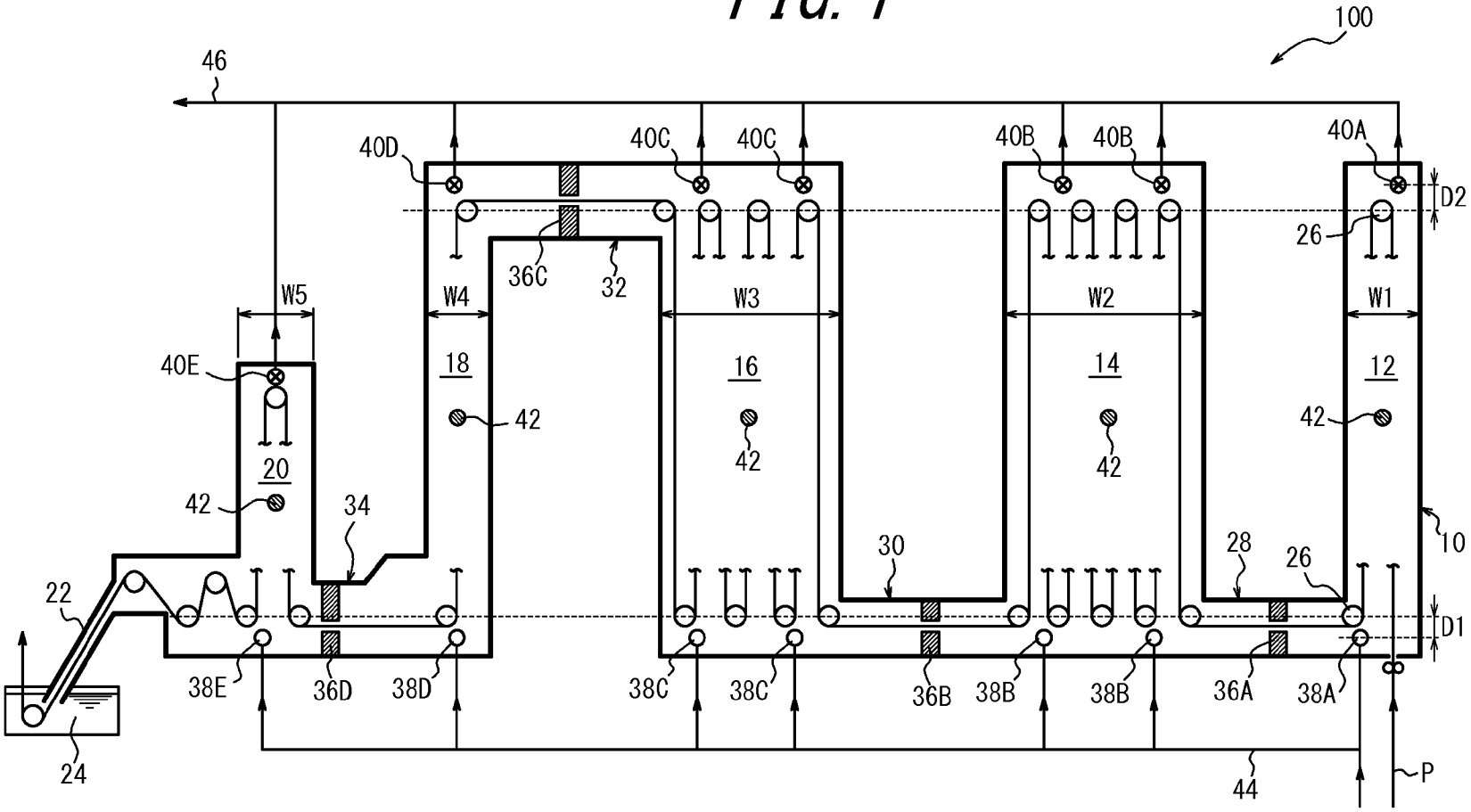
FIG. 1 is a schematic diagram illustrating the structure of a continuous hot-dip galvanising device 100 in an embodiment.

As illustrated in FIG. 1, a steel strip continuous annealing device in this embodiment has a vertical annealing furnace 10 in which a preheating zone 12, a heating zone 14, a soaking zone 16, and cooling zones 18 and 20 are arranged in this order from upstream to downstream. The cooling zone in this embodiment is composed of the first cooling zone 18 and the second cooling zone 20. The continuous annealing device anneals a steel strip P. One or more hearth rolls 26 are placed in upper and lower parts in each of the zones 12, 14, 16, 18, and 20. The steel strip P is folded back by 180 degrees at each hearth roll 26 to be conveyed up and down a plurality of times in the vertical annealing furnace 10, thus forming a plurality of passes. While FIG. 1 illustrates an example of having 2 passes in the preheating zone 12, 8 passes in the heating zone 14, 7 passes in the soaking zone 16, 1 pass in the first cooling zone 18, and 2 passes in the second cooling zone 20, the numbers of passes are not limited to such, and may be set as appropriate according to the processing condition. At some of the hearth rolls 26, the steel strip P is not folded back but changed in direction at the right angle to move to the next zone. The steel strip P thus passes through the zones 12, 14, 16, 18, and 20 in this order. Note that the preheating zone 12 may be omitted. A snout 22 linked to the second cooling zone 20 connects the vertical annealing furnace 10 to a molten bath 24 as a hot-dip galvanising device.

A continuous hot-dip galvanising device 100 in this embodiment includes the above-mentioned continuous annealing device and the molten bath 24 for hot-dip galvanising the steel strip P discharged from the second cooling zone 20.

The inside of the vertical annealing furnace 10 from the preheating zone 12 to the snout 22 is kept in a reductive atmosphere or a non-oxidizing atmosphere. In the preheating zone 12, the steel strip P is introduced from an opening (steel strip introduction portion) formed in its lower part, and heated by gas that has been heat-exchanged with combustion exhaust gas of the below-mentioned RT burner. In the heating zone 14 and the soaking zone 16, the steel strip P can be indirectly heated using a radiant tube (RT) (not illustrated) as heating means. The soaking zone 16 may be provided with a vertically extending partition wall (not illustrated) so as to leave an upper opening, within the range that does not impede the advantageous effects of the disclosure. After the steel strip P is heated for annealing to a predetermined temperature in the heating zone 14 and the soaking zone 16, the steel strip P is cooled in the first cooling zone 18 and the second cooling zone 20, and then immersed in the molten bath 24 through the snout 22 to be hot-dip galvanised. The galvanised coating may then be subjected to alloying treatment.

As reducing gas or non-oxidizing gas introduced into the vertical annealing furnace 10, $H_2$—$N_2$ mixed gas is typically used. An example is gas (dew point: about −60° C.) having a composition in which $H_2$ content is 1% to 10% by volume with the balance being $N_2$ and incidental impurities. The gas is introduced from gas delivery ports 38A, 38B, 38C, 38D, and 38E illustrated in FIG. 1 (hereafter reference sign 38 is also used for reference signs 38A to 38E collectively). The gas is supplied to these gas delivery ports 38 from a gas supply system 44 schematically illustrated in FIG. 1. The gas supply system 44 includes valves and flowmeters (not illustrated) as appropriate, to regulate or stop the gas supply to each gas delivery port 38 individually.

Moreover, in this embodiment, furnace gas which has high water vapor or oxygen content and is high in dew point is discharged from the vertical annealing furnace 10 through gas discharge ports 40A, 40B, 40C, 40D, and 40E (hereafter reference sign 40 is also used for reference signs 40A to 40E collectively). A gas discharge system 46 schematically illustrated in FIG. 1 is connected to a suction device, and includes valves and flowmeters as appropriate to regulate or stop the gas discharge from each gas discharge port 40 individually. The gas, having passed through the gas discharge port 40, is discharged after undergoing exhaust gas treatment.

Thus, in this embodiment, fresh gas is supplied from the gas delivery port 38 into the furnace at any time, and the gas discharged from the gas discharge port 40 undergoes exhaust gas treatment and is then discharged.

Since the internal pressure in each zone is usually 200 Pa to 400 Pa higher than atmospheric pressure, the gas in the furnace can be discharged even without the suction device. For discharge efficiency, however, it is preferable to provide the suction device. The gas discharged from the gas discharge port 40 includes flammable gas, and so is burned by a burner. For energy efficiency, the heat generated here is preferably used for gas heating in the preheating zone 12.

The continuous hot-dip galvanising device 100 in this embodiment has a characteristic structure in which the preheating zone 12, the heating zone 14, the soaking zone 16, the first cooling zone 18, and the second cooling zone 20 communicate through atmosphere separation portions, and the gas delivery port 38 and the gas discharge port 40 are provided in each of the preheating zone 12, the heating zone 14, the soaking zone 16, the first cooling zone 18, and the second cooling zone 20 in such a manner that one of the gas delivery port 38 and the gas discharge port 40 is positioned in the upper part and the other one of the gas delivery port 38 and the gas discharge port 40 is positioned in the lower part in each of the zones 12, 14, 16, 18, and 20.

Figure 3:
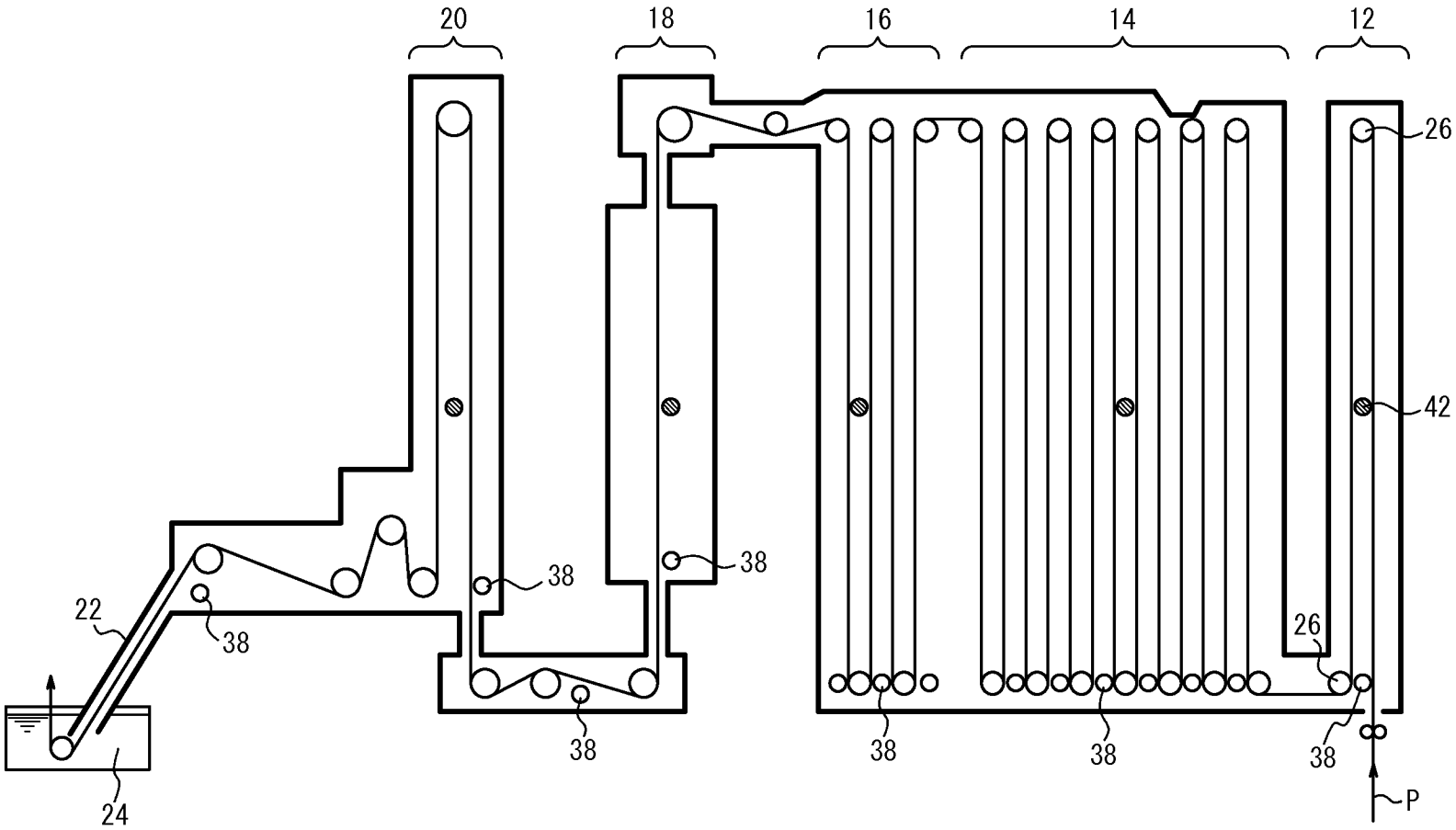
FIG. 3 is a schematic diagram illustrating the structure of a conventional continuous hot-dip galvanising device.

To identify the technical significance of the disclosure, an example of a conventional continuous hot-dip galvanising device is described below, with reference to FIG. 3. In FIG. 3, the same structural parts as those in the device in FIG. 1 are given the same reference signs. The continuous hot-dip galvanising device in FIG. 3 has a vertical annealing furnace in which a preheating zone 12, a heating zone 14, a soaking zone 16, and cooling zones 18 and 20 are arranged in this order and that is connected to a molten bath 24 through a snout 22. The heating zone 14 and the soaking zone 16 are integrated with each other. Gas is introduced into the furnace from gas delivery ports 38 provided in the lower parts of the zones 12 to 20 and the connecting portion between the cooling zones 18 and 20. The vertical annealing furnace has no gas discharge port. In such a continuous hot-dip galvanising device, the vertical annealing furnace is connected to the molten bath 24 through the snout 22. Accordingly, the gas introduced in the furnace is typically discharged from the furnace entrance side, i.e. the opening as the steel strip introduction portion in the lower part of the preheating zone 12, except for inevitable phenomenon such as leakage from the furnace, and the gas in the furnace flows from downstream to upstream in the furnace, which is opposite to the steel strip travel direction (from right to left in FIG. 3). With this structure, the gas stagnates in various parts in the furnace, so that the atmosphere in the furnace cannot be switched quickly.

According to the disclosure, on the other hand, the preheating zone, the heating zone, the soaking zone, and the cooling zone communicate through atmosphere separation portions. In detail, in this embodiment, a connecting portion 28 between the preheating zone 12 and the heating zone 14, a connecting portion 30 between the heating zone 14 and the soaking zone 16, a connecting portion 32 between the soaking zone 16 and the first cooling zone 18, and a connecting portion 34 between the first cooling zone 18 and the second cooling zone 20 form throats (restriction portions), and partition plates 36A, 36B, 36C, and 36D are provided in the connecting portions 28, 30, 32, and 34 (hereafter reference sign 36 is also used for reference signs 36A to 36D collectively). Each partition plate 36 extends from both sides of the steel strip P to the position close to the steel strip P. With this structure, the gas in each of the zones 12, 14, 16, 18, and 20 can be sufficiently kept from diffusing to its adjacent zone.

In such a situation, one of the gas delivery port and the gas discharge port is positioned in the upper part and the other one of the gas delivery port and the gas discharge port is positioned in the lower part in each zone. With this structure, the gas supplied from the gas delivery port and discharged from the gas discharge port in each zone flows from the upper part to lower part or from the lower part to upper part of the furnace. This sufficiently suppresses gas stagnation. In this embodiment, for example, the gas delivery port 38 is positioned in the lower part and the gas discharge port 40 is positioned in the upper part in all of the zones 12, 14, 16, 18, and 20, so that the gas flows from the lower part to upper part of the furnace in all zones.

As described above, the disclosed continuous annealing device and continuous hot-dip galvanising device are capable of independently controlling the atmosphere in each zone, and quickly switching the atmosphere in the furnace. Thus, the dew point of the atmosphere in the furnace can be quickly decreased to a level suitable for normal operation, before performing normal operation of continuously heat-treating a steel strip after opening the vertical annealing furnace to the air, or when the water concentration and/or the oxygen concentration in the atmosphere in the furnace increases during normal operation.

The structure of the atmosphere separation portion is not limited to that in this embodiment. For example, a seal roll or a damper may be placed in each of the connecting portions 28, 30, 32, and 34, instead of the partition plate 36. Alternatively, a gas-type separation device may be provided in the connecting portion to realize separation by an air curtain formed by seal gas such as $N_2$. These structures may be used in combination. To enhance the atmosphere separation, one or more types of separation members mentioned above are preferably provided in the connecting portions 28, 30, 32, and 34 as throats.

The atmosphere separation portion may be formed by narrowing each of the connecting portions 28, 30, 32, and 34 sufficiently so as to allow the steel strip P to pass through but suppress the diffusion of the furnace gas to the adjacent zone. In this case, regarding the shape dependent term of the Darcy-Weisbach equation, the value of the atmosphere separation portion is preferably greater than or equal to 10 times that of the zone. In detail, the following parameters are set for the atmosphere separation of the left zone, with reference to FIG. 2.

A: atmosphere separation direction

B: atmosphere non-separation direction

L: length (La: connecting portion length, Lb: zone length)

D: height (Da: connecting portion height, Db: zone height)

Figure 2:
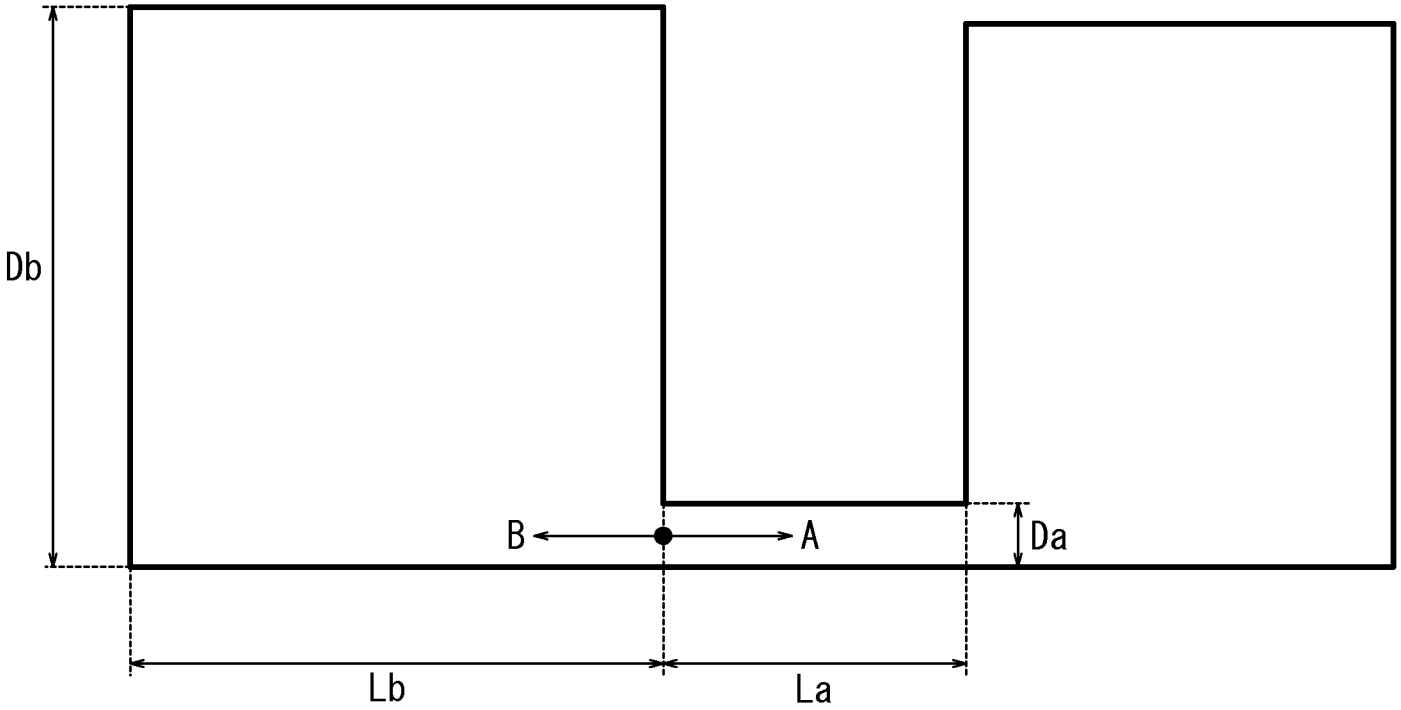
FIG. 2 is a schematic diagram illustrating an example of an atmosphere separation portion in the embodiment.

W: depth (Wa: connecting portion depth, Wb: zone depth, not illustrated in FIG. 2).

Then, the following Expression (3) is preferably satisfied:

[Math. 1]

$$La \times Ra^{-\frac{4}{3}} > 10Lb \times Rb^{-\frac{4}{3}} \qquad \text{Expression (3)}$$

where R=DW/{2(D+W)}.

The necessary degree of atmosphere separation is determined depending on the desired dew point, and the structure of the atmosphere separation portion can be designed as appropriate according to the degree of atmosphere separation.

According to the disclosure, the atmospheres in the respective zones are separated by the atmosphere separation portions, to enable independent atmosphere control in each zone. Here, which of the gas delivery port 38 and the gas discharge port 40 is positioned in the upper or lower part in each zone is not particularly limited. For example, it is possible to arrange the gas delivery port 38 and the gas discharge port 40 respectively in the lower part and the upper part in one zone, and arrange the gas delivery port 38 and the gas discharge port 40 respectively in the upper part and the lower part in another zone. In each zone, one of the gas delivery port and the gas discharge port is preferably positioned only in the upper part, and the other one of the gas delivery port and the gas discharge port only in the lower part.

Preferably, the gas delivery port 38 is positioned in the lower part and the gas discharge port 40 is positioned in the upper part in all of the zones 12, 14, 16, 18, and 20, as in this embodiment. This structure eases switching between normal operation and operation for switching the atmosphere in the furnace.

The reason is explained below. In normal operation not involving atmosphere switching, only the above-mentioned $H_2$—$N_2$ mixed gas is introduced from the gas delivery port 38, without discharging the furnace gas from the gas discharge port 40. Here, hydrogen in the $H_2$—$N_2$ mixed gas introduced into the furnace needs to be used efficiently. Hydrogen is low in density, and so can be diffused in the furnace more easily when the gas is introduced from the lower part of the furnace. Meanwhile, it is thermally advantageous to minimize the diffusion of the gas other than hydrogen in the furnace. In view of this, it is preferable to position the gas delivery port 38 in the lower part of the furnace.

Thus, the provision of the gas delivery port 38 in the lower part and the gas discharge port 40 in the upper part enables normal operation to be performed at low cost by effectively utilizing hydrogen and also minimizing heat loss, and also enables atmosphere switching to be performed quickly by discharging the furnace gas from the gas discharge port 40. By controlling the discharge rate from the gas discharge port 40, the balance between the cost and the atmosphere switching can be changed freely. The structure in this embodiment therefore has high compatibility with normal operation.

In this description, "the upper part of each zone" denotes the area that is 25% of the height of the zone from the upper end of the zone, and "the lower part of each zone" denotes the area that is 25% of the height of the zone from the lower end of the zone.

For efficient atmosphere switching in each of the zones 12, 14, 16, 18, and 20, the number of gas delivery ports 38 and the number of gas discharge ports 40 are preferably the same in each zone so that the gas delivery ports 38 and the gas discharge ports 40 in the upper and lower parts of the furnace are paired with each other.

In this embodiment, each of the lengths W1, W2, W3, W4, and W5 of the respective zones 12, 14, 16, 18, and 20 is preferably less than or equal to 7 m. For example, in the case where two pairs of gas delivery ports 38 and gas discharge ports 40 are provided in each zone, W1 to W5 are each preferably less than or equal to 7 m in order to effectively form gas flow from the upper part to lower part or from the lower part to upper part of the furnace. While gas flow can be formed to a certain extent if three or more pairs of gas delivery ports 38 and gas discharge ports 40 are provided, gas inevitably flows in the horizontal direction of the furnace. Accordingly, for atmosphere separation in each zone, W1 to W5 are each preferably less than or equal to 7 m. In the case where one pair of gas delivery port 38 and gas discharge port 40 are provided, on the other hand, W1 to W5 are each preferably less than or equal to 4 m.

In the case where the gas delivery port 38 is positioned in the lower part and the gas discharge port 40 is positioned in the upper part in all of the zones 12, 14, 16, 18, and 20 as in this embodiment, the flow rate Q per gas discharge port 40 in each zone is preferably high in terms of atmosphere switching efficiency. The flow rate Q is preferably set as follows. The flow rate Q ($m^3$/hr) preferably satisfies $Q>3.93\times V$, where V ($m^3$) is the volume of the zone per pair of gas delivery port and gas discharge port. For example, in the case where V=200 $m^3$, the flow rate Q preferably exceeds 786 $m^3$/hr. Here, it is preferable to set the upper limit to less than or equal to 3930 $m^3$/hr in terms of cost.

Moreover, the flow rate Q ($m^3$/hr) per gas discharge port 40 in each zone preferably satisfies $Q>1.31\times V_0$, where $V_0$ ($m^3$) is the volume of the zone regardless of the number of pairs of gas delivery ports and gas discharge ports.

Note that such a flow rate Q ($m^3$/hr) is a value converted on an assumption that the atmospheric temperature in the furnace is 800° C.

The flow rate per gas delivery port 38 in each zone may be set as appropriate based on the above-mentioned flow rate Q.

The delivery rate from the gas delivery port 38 and the discharge rate from the gas discharge port 40 can each be regulated by controlling the opening and closing of the port. For example, in the case where the dew point needs to be lowered, the gas delivery port 38 and the gas discharge port 40 are fully opened to form strong gas flow in the furnace, thus realizing quick atmosphere switching. In the case where the dew point does not need to be lowered, the gas discharge port 40 may be closed for fuel-efficient operation. When the gas discharge port 40 is closed, the amount of gas necessary to maintain the furnace pressure can be reduced, which reduces gas usage and enables operation at low running cost. For example, such control that closes the gas discharge port 40 while the dew point can be kept low and, when the dew point reaches a threshold (e.g. −30° C.), opens the gas discharge port 40 to quickly lower the dew point may be performed.

The connecting portions 28, 30, 32, and 34 may be positioned in any of the upper part and lower part of the furnace. For normal operation not involving atmosphere switching, the connecting portion is preferably positioned in the lower part. This is because, since hydrogen in the reducing gas is low in density as mentioned above, hydrogen tends to be concentrated in the upper part, and may diffuse to the adjacent section if the connection is in the upper part. Hence, the connecting portion 28 between the preheating zone 12 and the heating zone 14 and the connecting portion 30 between the heating zone 14 and the soaking zone 16 are preferably provided in the lower part of the furnace as in this embodiment, to maintain the tightness of the atmosphere in each zone more easily. On the other hand, the connecting portion 32 between the soaking zone 16 and the first cooling zone 18 is preferably provided in the upper part of the furnace, to suppress gas mixture. This is because, since the first cooling zone 18 is lower in temperature than the soaking zone 16, there is a possibility that the gas in the first cooling zone 18 having a high specific gravity enters into the soaking zone 16 in large quantity in the case where the connecting portion 32 is provided in the lower part of the furnace. Meanwhile, the connection between the cooling zones has no constraint in terms of atmosphere control, and so the connecting portion 34 between the first cooling zone 18 and the second cooling zone 20 may be conveniently positioned according to the necessary number of passes.

The disclosed continuous annealing device and continuous hot-dip galvanising device are capable of quickly switching the atmosphere in the furnace, and accordingly not only have the advantageous effect of lowering the dew point but also are beneficial in terms of operation efficiency in the case where the atmosphere in the furnace needs to be replaced upon changing the steel type or the like. For example, in the case of manufacturing a high tensile strength material in a high dew point atmosphere, the inside of the furnace needs to be switched from a low dew point atmosphere to a high dew point atmosphere. The disclosed continuous annealing device can perform such atmosphere switching quickly. In addition, the disclosed continuous annealing device is capable of individually controlling hydrogen in each zone, so that hydrogen can be concentrated in a necessary zone. For example, concentrating hydrogen in the cooling zone contributes to a higher cooling capacity, and concentrating hydrogen in the soaking zone contributes to a higher $H_2/H_2O$ ratio, with it being possible to improve the coating property of the high tensile strength material and the like and the heating efficiency. Furthermore, for example in the case of introducing ammonia in a specific part for nitriding treatment, the introduction can be efficiently performed by changing hydrogen to ammonia.

The disclosure relates to facility configurations, and exhibits significantly advantageous effects when applied at the time of construction rather than modification to existing facilities. New facilities to which this disclosure is applied can be constructed substantially at the same cost as conventional facilities.

EXAMPLES

The following describes a dew point measurement test performed using the continuous hot-dip galvanising device illustrated in FIG. 1 according to the disclosure and the continuous hot-dip galvanising device illustrated in FIG. 3 as Comparative Example.

The ART (all radiant) CGL device illustrated in FIG. 1, the overall structure of which has been described above, has the following specific structure. The distance between the upper and lower hearth rolls is 20 m (10 m in the second cooling zone). The volume $V_0$ of each zone and the volume V of each zone per pair of gas delivery port and gas discharge port are as indicated in Table 1. The zone length is 1.5 m in the preheating zone, 6.8 m in the heating zone, 6.0 m in the soaking zone, 1.0 m in the first cooling zone, and 1.5 m in the second cooling zone. The gas delivery port has a diameter of 50 mm, and the center of the gas delivery port is located 1 m below the center of the lower hearth roll in the furnace (D1=1 m in FIG. 1). The gas discharge port has a diameter of 100 mm, and the center of the gas discharge port is located 1 m above the center of the upper hearth roll in the furnace (D2=1 m in FIG. 1). The dew point of the gas delivered from the gas delivery port is −70° C. to −60° C., and the total gas supply capacity from all gas delivery ports is 2000 $Nm^3/hr$ ($N_2$=1800 $Nm^3/hr$, $H_2$=200 $Nm^3/hr$). The connecting portion of each zone is provided with a partition plate to enhance the atmosphere separation. The distance from the tip of the partition plate to the surface of the steel strip is 50 mm on both of the front and back sides of the steel strip, and the length of the partition plate in the direction in which the steel strip passes through is 500 mm. A dew point meter is placed in a center part (position 42 in FIG. 1) in each zone.

The ART (all radiant) CGL device illustrated in FIG. 3, the overall structure of which has been described above, has the following specific structure. The distance between the upper and lower hearth rolls is 20 m. The zone volume is 80 $m^3$ in the preheating zone, 840 $m^3$ in the combination of the heating zone and the soaking zone, 65 $m^3$ in the first cooling zone, and 65 $m^3$ in the second cooling zone. Each gas delivery port is disposed in the position illustrated in FIG. 3, and has a diameter of 50 mm. The dew point of the gas delivered from the gas delivery port is −70° C. to −60° C., and the gas supply capacity from all gas delivery ports is the same as that in FIG. 1. A dew point meter is placed in a center part (position 42 in FIG. 3) in each zone.

Figure 4A:
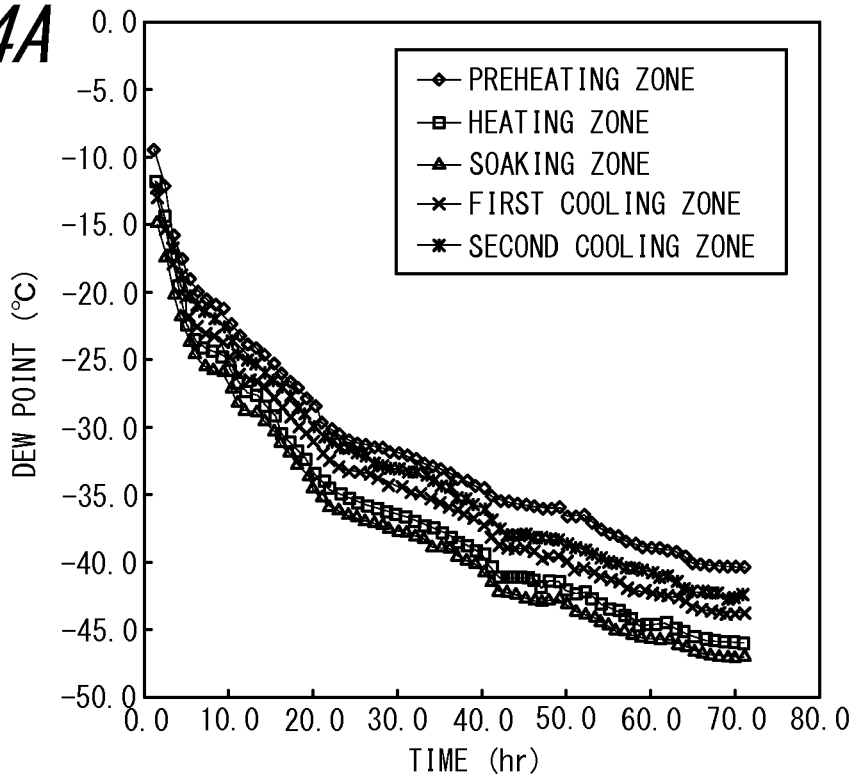
FIG. 4A is a graph illustrating the temporal changes of the dew point in a vertical annealing furnace in Example.
Figure 4B:
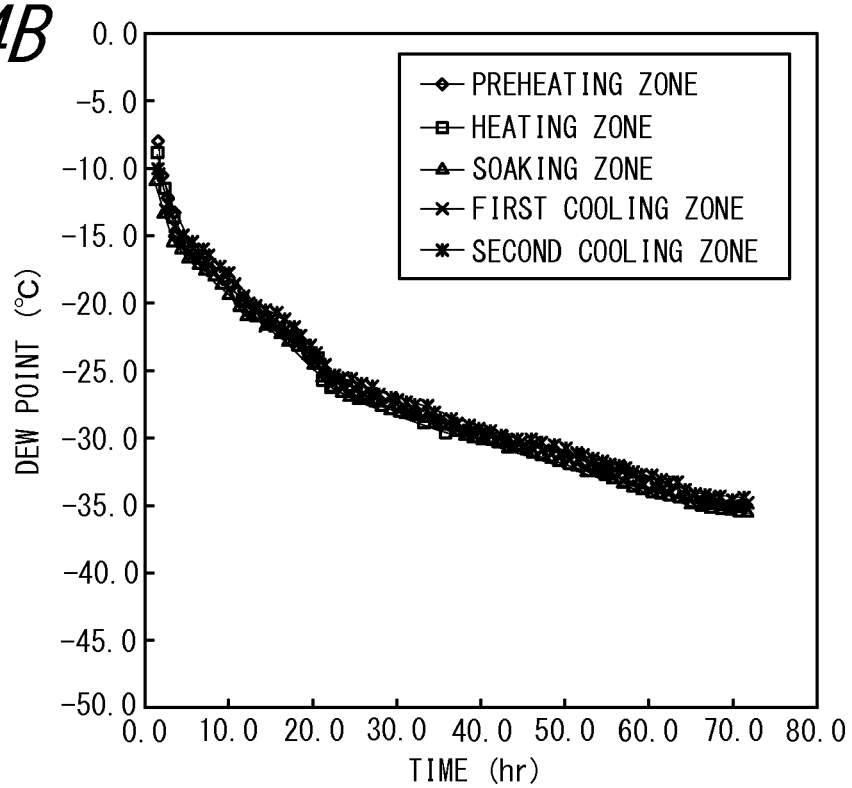
FIG. 4B is a graph illustrating the temporal changes of the dew point in a vertical annealing furnace in Comparative Example.

In each of the continuous hot-dip galvanising devices, upon startup after opening the vertical annealing furnace to the air, atmospheric gas containing water vapor or oxygen of about −10° C. was present in the furnace (see 0 hr in FIGS. 4A and 4B). Operation was then started in the following conditions. The size of the steel strip is 900 mm to 1100 mm in width and 0.8 mm to 1.0 mm in sheet thickness, and the steel type is as indicated in Table 2. The sheet passing speed is 100 mpm to 120 mpm (except immediately after line start), and the annealing temperature is 780° C. to 820° C.

The total gas delivery rate from all gas delivery ports is 1200 $Nm^3/hr$ to 1600 $Nm^3/hr$ ($H_2$: 120 $Nm^3/hr$ to 160 $Nm^3/hr$) in Example in FIG. 1, and 900 $Nm^3/hr$ to 1100 $Nm^3/hr$ ($H_2$: 90 $Nm^3/hr$ to 110 $Nm^3/hr$) in Comparative Example in FIG. 3. The delivery flow rate per port is the same.

In Example in FIG. 1, the flow rate Q per gas discharge port in each zone is as indicated in Table 1. In Comparative Example in FIG. 3 having no gas discharge ports, the gas was discharged only from the entrance side of the vertical annealing furnace.

TABLE 1

| | Preheating zone | Heating zone | Soaking zone | First cooling zone | Second cooling zone |
|---|---|---|---|---|---|
| $V_0$ ($m^3$) | 80 | 375 | 330 | 55 | 35 |
| Number of pairs of delivery and discharge ports | 1 | 2 | 2 | 1 | 1 |
| V ($m^3$) | 80 | 187.5 | 165 | 55 | 35 |
| Right side of Expression (1) 3.93 × V | 314.4 | 736.875 | 648.45 | 216.15 | 137.55 |
| Right side of Expression (2) 1.31 × $V_0$ | 104.8 | 491.25 | 432.3 | 72.05 | 45.85 |
| Q ($Nm^3$/hr) | 100 | 200 | 180 | 60 | 60 |
| Q ($m^3$/hr) | 393 | 786 | 707.4 | 235.8 | 235.8 |

TABLE 2

| C | Si | Mn | S | (mass %) Al |
|---|---|---|---|---|
| 0.12 | 0.5 | 1.7 | 0.003 | 0.03 |

FIGS. 4A and 4B illustrate the temporal changes of the dew point in each zone in the vertical annealing furnace from the operation start. In Comparative Example, about 40 hours were needed for the dew point to fall below −30° C., as illustrated in FIG. 4B. In Example, on the other hand, the dew point reached −30° C. in about 20 hours in all zones, as illustrated in FIG. 4A. Particularly in the soaking zone which is important in manufacture of high tensile strength materials, the dew point reached −30° C. in 13 hours.

The dew point reached after 70 hours was near −35° C. in Comparative Example, but less than or equal to −40° C. in all locations in Example. Particularly in the soaking zone, the dew point decreased to less than or equal to −46° C., creating a state suitable for manufacture of high tensile strength materials.

In Example, the flow rate Q per gas discharge port in each zone is set to satisfy Expressions (1) and (2), thus enabling efficient atmosphere switching. In Comparative Example, in the heating zone and the soaking zone ($V_0$=840 $m^3$, the number of pairs of gas delivery ports and gas discharge ports: 9), Q>1100.4 $m^3$/hr=280 $Nm^3$/hr and the total flow rate exceeding 2520 $Nm^3$/hr (9903.6 $m^3$/hr) are needed to satisfy Expressions (1) and (2), which is not economical.

For efficient atmosphere switching, it is important to suppress stagnation of gas flow in the furnace. We studied the suitable length of each zone for this purpose, using a flow analysis method (computational fluid dynamics (CFD)). Gas discharge ports were arranged in an upper part (position of 0.5 m from the top) of a rectangular parallelepiped (variable in length, 20 m in height, and 2.5 m in depth), and gas delivery ports were arranged in a lower part (position of 0.5 m from the bottom) of the rectangular parallelepiped. The number of pairs of delivery and discharge ports was 1 per meter of the length of the rectangular parallelepiped, the diameter was 50 mm, and the flow rate at each gas delivery port was 100 $m^3$/hr. Flow analysis was conducted in this condition, to evaluate the time until all flow lines were sucked to the gas discharge ports from inside the rectangular parallelepiped. Note that the number of flow lines was 100 lines/$m^3$, k-ϵ model was used as a random number model, and the energy term was not taken into account.

Figure 5:
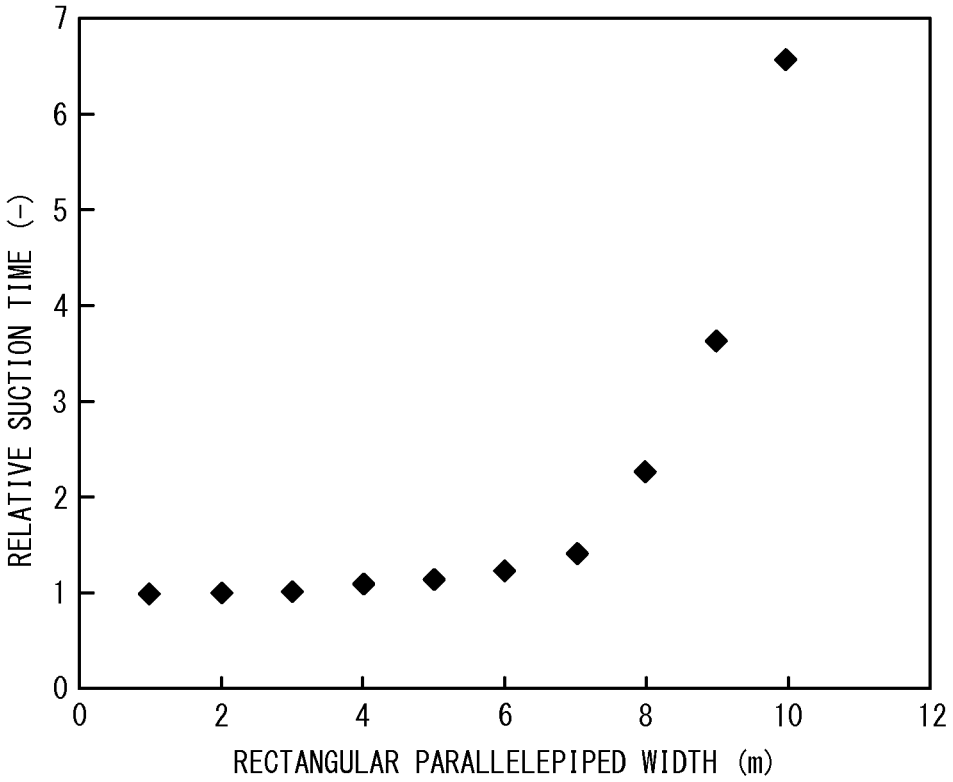
FIG. 5 is a graph illustrating the relationship between the rectangular parallelepiped width and the relative suction time according to flow analysis.

FIG. 5 illustrates the flow analysis result. As can be understood from FIG. 5, in the case where the length of the rectangular parallelepiped is less than or equal to 7 m, the suction time is approximately at a minimum, and effective atmosphere switching is possible. This demonstrates that gas stagnation can be effectively suppressed by limiting the length of the rectangular parallelepiped to less than or equal to the predetermined length to limit the degree of freedom of gas movement.

INDUSTRIAL APPLICABILITY

It is possible to provide a steel strip continuous annealing device and continuous hot-dip galvanising device capable of quickly switching the atmosphere in a furnace.

REFERENCE SIGNS LIST

100 continuous hot-dip galvanising device
10 vertical annealing furnace
12 preheating zone
14 heating zone
16 soaking zone
18 first cooling zone
20 second cooling zone
22 snout
24 molten bath (hot-dip galvanising device)
26 hearth roll
28, 30, 32, 34 connecting portion (throat)
36A to 36D partition wall
38A to 38E gas delivery port
40A to 40E gas discharge port
42 dew point measurement position
44 gas supply system
46 gas discharge system
P steel strip

The invention claimed is:

1. A steel strip continuous annealing device that has a vertical annealing furnace in which a heating zone, a soaking zone, and a cooling zone are arranged in the stated order, and anneals a steel strip passing through the zones in the order while being conveyed in a vertical direction in the vertical annealing furnace, comprising:

a first throat extending in a lateral direction and provided between the heating zone and the soaking zone;

a second throat extending in the lateral direction and provided between the soaking zone and the cooling zone;

an atmosphere separation portion including at least one of a partition plate, a seal roll, a damper, and a gas separation device forming an air curtain;

a gas delivery port for introducing gas into the vertical annealing furnace; and a gas discharge port for discharging gas from the vertical annealing furnace, wherein the heating zone, the soaking zone, and the cooling zone communicate through the first throat and the second throat, the atmosphere separation portion is provided in each of the first throat and the second throat to separate an atmosphere in the heating zone from an atmosphere in the soaking zone and to separate an atmosphere in the soaking zone from an atmosphere in the cooling zone, the gas delivery port and the gas discharge port are provided in each of the heating zone, the soaking zone, and the cooling zone, one of the gas delivery port and the gas discharge port is positioned in an upper part and the other one of the gas delivery port and the gas discharge port is positioned in a lower part in each of the zones, the steel strip continuous annealing device is configured to be switchable between a first mode and a second mode, in the first mode the gas delivery port and the gas discharge port provided in each of the heating zone, the soaking zone, and the cooling zone are opened so as to switch the atmosphere in each of the zones, and in the second mode the gas delivery port provided in each of the zones is opened and the gas discharge port in each of the zones is closed for operation, and wherein the steel strip continuous annealing device is switched to the first mode when a dew point inside the vertical annealing furnace reaches a threshold temperature, and to the second mode when the dew point inside the vertical annealing furnace is below the threshold temperature.

2. The steel strip continuous annealing device according to claim 1, wherein a preheating zone is arranged upstream of the heating zone, a third throat extending in the lateral direction is provided between the preheating zone and the heating zone, the preheating zone and the heating zone communicate through the third throat, the atmosphere separation portion is also provided in the third throat to separate an atmosphere in the preheating zone from an atmosphere in the heating zone, and one of the gas delivery port and the gas discharge port is positioned in the upper part and the other one of the gas delivery port and the gas discharge port is positioned in the lower part in the preheating zone.

3. The steel strip continuous annealing device according to claim 1, wherein the gas delivery port is positioned in the lower part and the gas discharge port is positioned in the upper part in all of the zones.

4. The steel strip continuous annealing device according to claim 3, wherein a flow rate Q ($m^3$/hr) per gas discharge port in each zone satisfies conditions of Expression (1) and Expression (2)

$$Q>3.93\times V \quad \text{Expression (1)}$$

$$Q>1.31\times V_0 \quad \text{Expression (2)}$$

where $V_0$ ($m^3$) is a volume of the zone, and V ($m^3$) is a volume of the zone per pair of gas delivery port and gas discharge port.

5. The steel strip continuous annealing device according to claim 1, wherein a length of each of the zones is 7 m or less.

6. A continuous hot-dip galvanising device comprising:

the steel strip continuous annealing device according to claim 1; and a hot-dip galvanising device that hot-dip galvanises the steel strip discharged from the cooling zone.

* * * * *